US010806654B2

(12) United States Patent
Cheek

(10) Patent No.: US 10,806,654 B2
(45) Date of Patent: Oct. 20, 2020

(54) MOTORIZED CHAIR

(71) Applicant: Larry Nelson Cheek, Ullin, IL (US)

(72) Inventor: Larry Nelson Cheek, Ullin, IL (US)

( * ) Notice: Subject to any disclaimer, the term of this patent is extended or adjusted under 35 U.S.C. 154(b) by 0 days.

(21) Appl. No.: 16/778,563

(22) Filed: Jan. 31, 2020

(65) Prior Publication Data

US 2020/0163819 A1 May 28, 2020

Related U.S. Application Data

(63) Continuation-in-part of application No. 15/421,973, filed on Feb. 1, 2017, now Pat. No. 10,548,792.

(51) Int. Cl.

| | |
|---|---|
| ***A61G 7/10*** | (2006.01) |
| ***A61G 5/04*** | (2013.01) |
| ***A61G 5/10*** | (2006.01) |

(52) U.S. Cl.

CPC ..... *A61G 7/1017* (2013.01); *A61G 5/043* (2013.01); *A61G 5/1056* (2013.01); *A61G 5/1089* (2016.11); *A61G 7/1048* (2013.01); *A61G 7/1051* (2013.01)

(58) Field of Classification Search

CPC ..... A61G 7/1017; A61G 7/053

See application file for complete search history.

(56) References Cited

U.S. PATENT DOCUMENTS 3,964,786 A * 6/1976 Mashuda ..... A61G 5/006 297/330

4,407,543 A * 10/1983 Mashuda ..... A61G 5/006 180/907

5,333,333 A * 8/1994 Mah ..... A61G 5/10 280/250.1

5,379,468 A * 1/1995 Cassidy ..... A61G 5/045 280/304.1

6,231,067 B1 * 5/2001 Johnson ..... A61G 5/14 180/65.1

(Continued)

FOREIGN PATENT DOCUMENTS

| | | |
|---|---|---|
| CH | 593056 A5 | 11/1977 |
| WO | 2014016798 A1 | 1/2014 |

OTHER PUBLICATIONS

International Search Report, International Application No. PCT/US2018/144100, dated Feb. 21, 2018, 5 pages.

*Primary Examiner* — Sarah B McPartlin

(74) *Attorney, Agent, or Firm* — Creativenture Law, LLC; Dennis J M Donahue, III; Kevin Staed

(57) ABSTRACT

A mobility chair has a base frame with a seat bottom, a seatback, motorized drive wheels, and safety wheels, an actuated hoist with a mast, boom, winch, and sling that has a stowed configuration and an operative configuration, and outriggers that have a retracted configuration proximate to the base frame and an extended configuration ahead of the mobility chair. The boom is raised and its forward portion is rotated ahead of the frontmost section of the seat while its rear portion remains behind the boom. The seatback can be raised from the base frame and can also be hingedly connected to the seat bottom which rotates relative to the base frame through a bracket in the front section so that as the seatback is raised, the seat bottom rotates with the seatback into an upright standing configuration with the seat bottom aligned with the seatback in the vertical orientation.

20 Claims, 8 Drawing Sheets

(56) References Cited

U.S. PATENT DOCUMENTS

| | | | | |
|---|---|---|---|---|
| 6,793,232 | B1 * | 9/2004 | Wing | A61G 5/006 280/304.1 |
| 8,322,741 | B2 | 12/2012 | Laslo et al. | |
| 8,844,961 | B2 | 9/2014 | Hunziker | |
| 9,033,360 | B2 | 5/2015 | Davis et al. | |
| 10,386,936 | B2 | 8/2019 | Stucki et al. | |
| 2014/0165287 | A1 | 6/2014 | Jessen | |

* cited by examiner

MOTORIZED CHAIR

CROSS-REFERENCE TO RELATED APPLICATIONS

This application is a continuation-in-part of U.S. patent application Ser. No. 15/421,973 filed on Feb. 1, 2017 which is incorporated by reference.

STATEMENT REGARDING FEDERALLY SPONSORED RESEARCH

Not Applicable.

APPENDIX

Not Applicable.

COPYRIGHT NOTICE

A portion of the disclosure of this patent document contains material that is subject to copyright protection by the author thereof. The copyright owner has no objection to the facsimile reproduction by anyone of the patent document or patent disclosure for the purposes of referencing as patent prior art, as it appears in the Patent and Trademark Office, patent file or records, but otherwise reserves all copyright rights whatsoever.

BACKGROUND OF THE INVENTION

Field of the Invention

The present invention generally relates to mobility aids. More particularly, the invention relates to a motorized mobility aiding wheelchair with an integrated hoist for raising and lowering a patient.

Related Art

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon. Many individuals with mobility issues due to various causes such as, but not limited to, age, accidents, or medical conditions, may use wheelchairs or motorized wheelchairs to improve their mobility. In some instances, these individuals may have difficulty getting into and out of such chairs even with the help of a caregiver. For example, without limitation, an individual that has little to no use of his or her legs may have difficulty transferring himself from a bed to the wheelchair or vice versa. Furthermore, a caregiver may not have the strength to lift the individual from the bed to transfer the individual to the wheelchair or vice versa. In addition, if an individual with mobility issues falls, it may be difficult or impossible for the individual to safely get back into bed or the wheelchair with or without caregiver assistance.

By way of educational background, the prior art teaches some apparatus for assisting an individual into or out of a wheelchair or motorized wheelchair. One such apparatus may provide a motorized wheelchair that elevates an occupant from a sitting position to any position up to an upright standing position. Such approaches may not provide means for moving the occupant to another location, for example without limitation to a bed, once the occupant is in a standing position. Other approaches may provide power lifts or manual lifts. These lifts typically comprise a sling which may be attached to an individual connected to a hoist to lift the individual and move the individual from one location to another. These lifts are often large and heavy and may be difficult to maneuver. Some facilities may require two caregivers to operate such lifts as maneuvering the weight of the lift and an onboard patient after lifting may be too strenuous for one individual. The size and weight of these lifts may result in difficulty in transporting the lifts particularly if the ground surface is not smooth and level, for example without limitation, up or down a ramp or across carpeted surfaces. Such approaches may cause discomfort to the individual being transported by the lift. For example, without limitation, the sling may exert uncomfortable pressure on various portions of the individual's body. Yet other approaches may provide overhead rail systems. Such approaches may have limited flexibility since their use may typically be limited to areas in which rails have been installed.

The general concept of a motorized wheelchair with a hoist is described in U.S. Pat. No. 5,409,250 by Gyula Csotonyi. However, the crane hoist as it is particularly disclosed in the Csotonyi '250 Patent has several limitations and drawbacks that are overcome by the improved features and functionality of the present invention. The crane hoist has a boom that is positioned above the wheelchair seat in its operative position, and although the back of the seat can be actuated upward relative to the front of the wheelchair, the seatback cannot move forward as the seat bottom rotates so that the seatback and seat bottom are substantially in the same plane nor can the boom telescope forward, and these limitations prevent the front of the boom from extending ahead of the front of the seat bottom. Therefore, when a person is situated on the ground ahead of the front of the seat with the sling around their body and the motor driven feed spool pulls the sling through the cable, the person and the sling are necessarily pulled inward towards the front of the seat as well as being pulled upward. Since the front of the boom does not extend ahead of the front of the seat, a person held by the string cannot be lifted straight upwards and could actually be dragged along the ground before being lifted upwards. It will also be appreciated that the particular actuation of the front and back seat with linear telescopic members that do not rotate cannot possibly rotate the seat bottom into a vertical orientation with the seatback. Modifying the crane hoist so that the boom extends ahead of the seat would change the principle of operation of the Csotonyi '250 Patent and could render particular aspects of the Csotonyi '250 Patent unworkable, such as the ability of the linear telescopic members to lift both the seatback and seat bottom together so that a person in the seated position can reach objects that would otherwise be too high to grasp.

It is also noted that the boom of the crane in the Csotonyi '250 Patent is fully cantilevered with the rearward end of the boom in the operative configuration being fixed directly to the mast of the crane. There is no rearward end of the boom behind the mast which can be secured to the mast to support the cantilevered end extending forward of the mast. This requires a more bulky and fixed bracket attaching the boom to the mast so that the boom does not rotate relative to the mast. Additionally, there is no telescoping of the boom in the crane in the Csotonyi '250 Patent.

In view of the foregoing, it is clear that the prior art devices have drawbacks and limitations that leave room for improvements in a motorized wheelchairs with a hoist.

SUMMARY OF THE INVENTION

A mobility chair according to the present invention has a base frame that has a seat bottom, a seatback, motorized drive wheels, and safety wheels, a hoist that has a stowed configuration and an operative configuration, and outriggers that have a retracted configuration proximate to the base frame and an extended configuration ahead of the mobility chair.

The hoist has a mast, a boom, a winch, and a sling, and in one aspect of the invention, the forwardmost end of the boom is moved from a fully retracted positon behind the seatback when the hoist is in the stowed configuration to a fully extended position in which a winch line from the winch hangs along a vertical lift axis ahead of the front portion of the base frame when the hoist is in the operative configuration, and the forwardmost end of the boom extends ahead of a forwardmost section of the seat bottom in the fully extended position while at least a portion of the boom is behind the mast.

In another aspect of the present invention, the boom is telescopic with a proximal segment and a distal segment. The distal segment longitudinally translates relative to the proximal segment, and the winch is connected to and translates with the distal segment. Additionally, the forwardmost end of the distal segment moves between a fully retracted positon behind the seatback when the hoist is in the stowed configuration to a fully extended position with the winch line hanging along a vertical lift axis ahead of the front portion of the base frame when the hoist is in the operative configuration.

In yet another aspect of the present invention, the seat bottom and the seatback have a standard seating configuration with the seat bottom in a substantially horizontal orientation and the seatback being in a substantially vertical orientation; and the seat bottom and the seatback also have an upright standing configuration with the seat bottom being substantially aligned with the seatback in a substantially vertical orientation. When the seat bottom and seatback are in the upright standing configuration, the outriggers are in the extended configuration.

Another aspect of the present invention relates to the low profile nature of the mobility chair when the hoist is in its stowed configuration in which the hoist folds into the back of the wheelchair such that the height and the length of the wheelchair are not significantly impacted. In particular, a top end of the hoist in the stowed configuration is in a horizontal plane that is at or below a height that is no more than 120% of the uppermost seat height and the thickness of the hoist ($t_h$) in the stowed configuration (i.e., its thickness on the back of the wheelchair) is less than a front wheelbase between the drive wheels and the safety wheels and is also less than a rear wheelbase between the drive wheels and the turning wheels.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings as briefly described below.

FIG. 2A is a transparent front view of the sling. FIG. 2B is a diagrammatic front view of a cam plate. FIG. 2C is an exploded front view of a lower portion of the sling with a retractable safety strap, and FIG. 2D is a transparent side view of the lower portion of the sling with the retractable safety strap;

FIG. 3A is a diagrammatic side view, and FIG. 3B is a diagrammatic front view.

FIG. 6A is a side view with the seat in a standard seating configuration, the hoist in a stowed configuration, and the outriggers in a retracted configuration. FIG. 6B is a side view with the seat in an upright standing configuration, the hoist in an operative configuration, and the outriggers in an extended configuration. FIGS. 6C and 6D are front view and a back view, respectively, with the seat in the upright standing configuration, the hoist in the operative configuration, and the outriggers in the extended configuration. FIGS. 6E and 6F are a top view and a bottom view, respectively, with the seat in the upright standing configuration, the hoist in the operative configuration, and the outriggers in the extended configuration.

DETAILED DESCRIPTION OF THE PREFERRED EMBODIMENTS

The following description of the preferred embodiment(s) is merely exemplary in nature and is in no way intended to limit the invention, its application, or uses.

As described below and shown in the accompanying drawings, the present invention includes innovative features for a mobility chair. Some embodiments may combine an integrated patient hoist with the motorized wheelchair. The various functions that may be accomplished individually and in combination with each other by the motorized wheelchair with the hoist include, without limitation, lifting a person that is next to the motorized wheelchair and requires assistance getting up and into the seat or is in the seat and requires assistance getting up out of the seat to another location adjacent to the motorized wheelchair, transporting the person while in the seated position, and providing support to a person while in a standing position.

Figure 1:
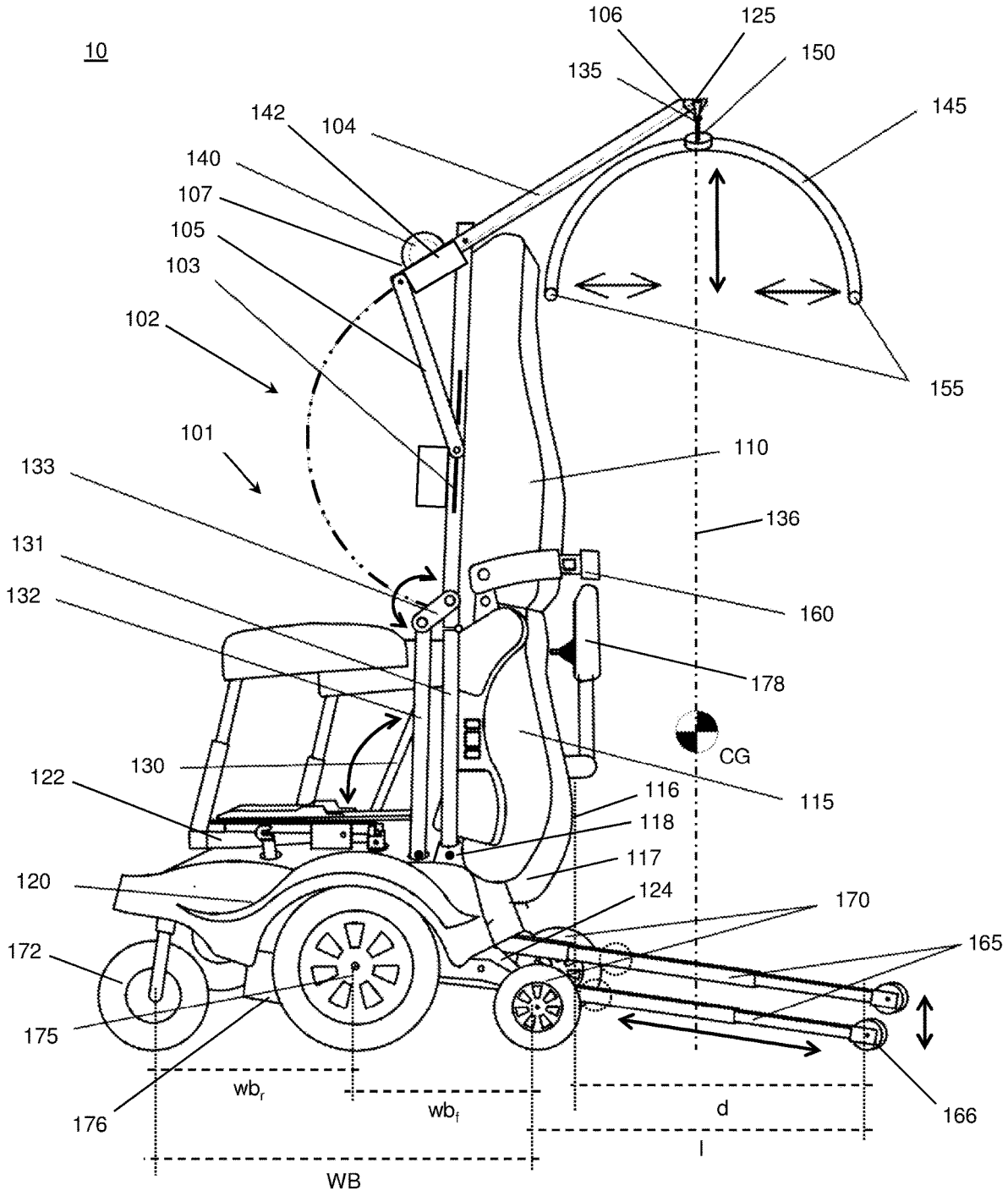
FIG. 1 is a side perspective view of an exemplary motorized wheelchair with an attached hoist, in accordance with a first embodiment of the present invention.
Figure 3A:
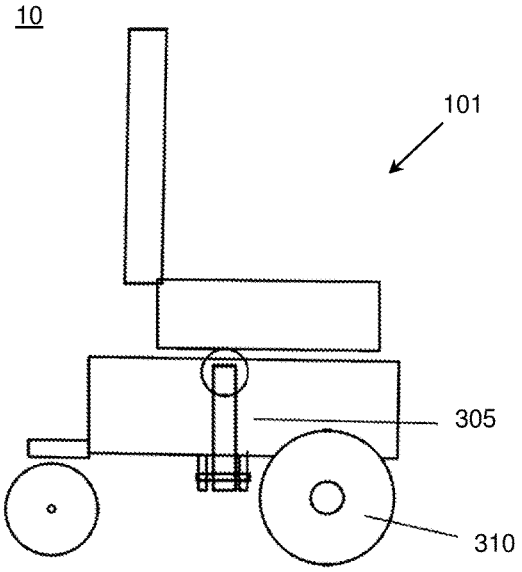
FIGS. 3A and 3B illustrate an exemplary motorized wheelchair with a retractable outrigger attached to the side, in accordance with a second embodiment of the present invention.
Figure 6A:
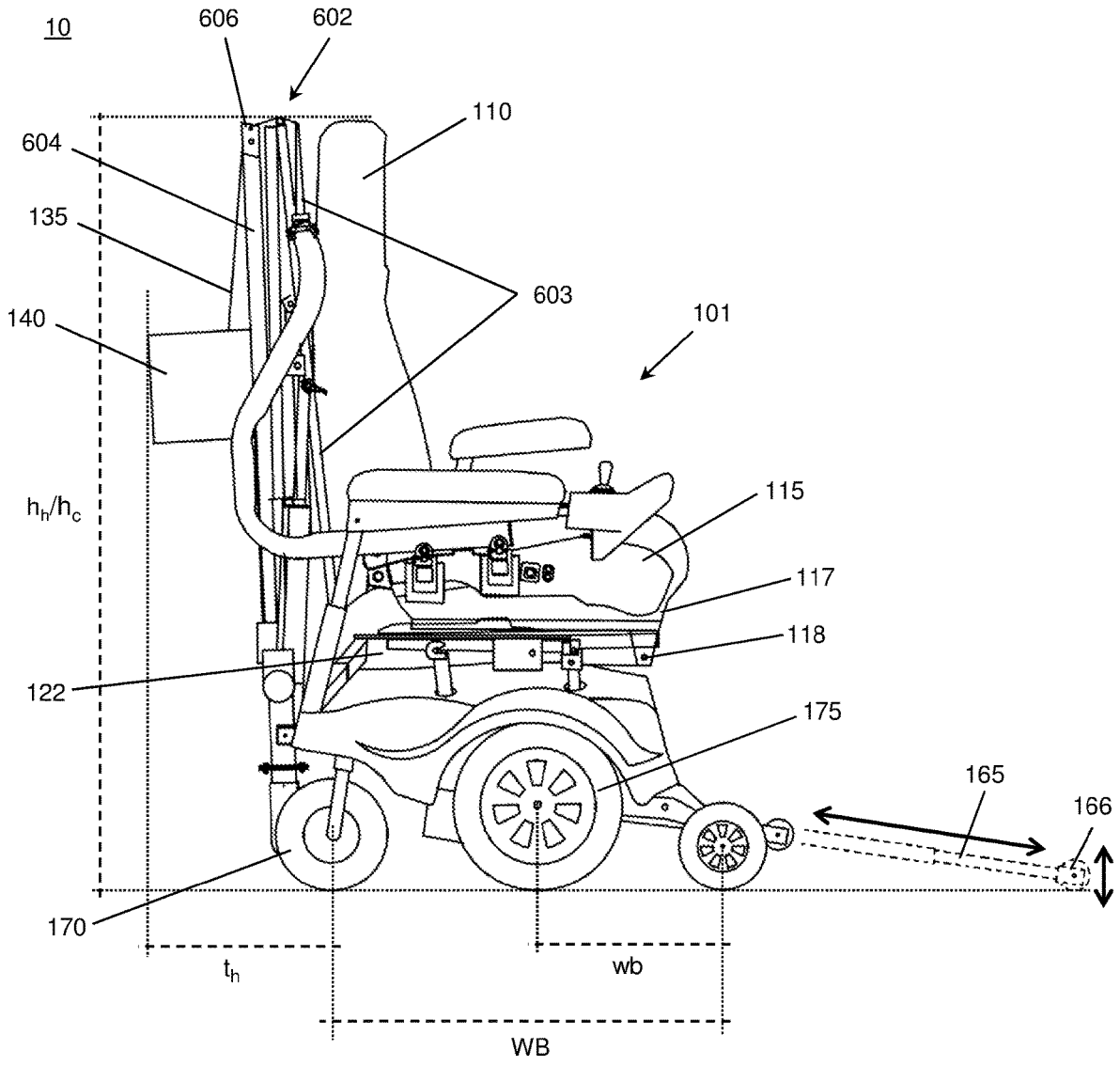
FIGS. 6A-6F illustrate an exemplary motorized wheelchair with an attached hoist, in accordance with a third embodiment of the present invention.
Figure 6B:
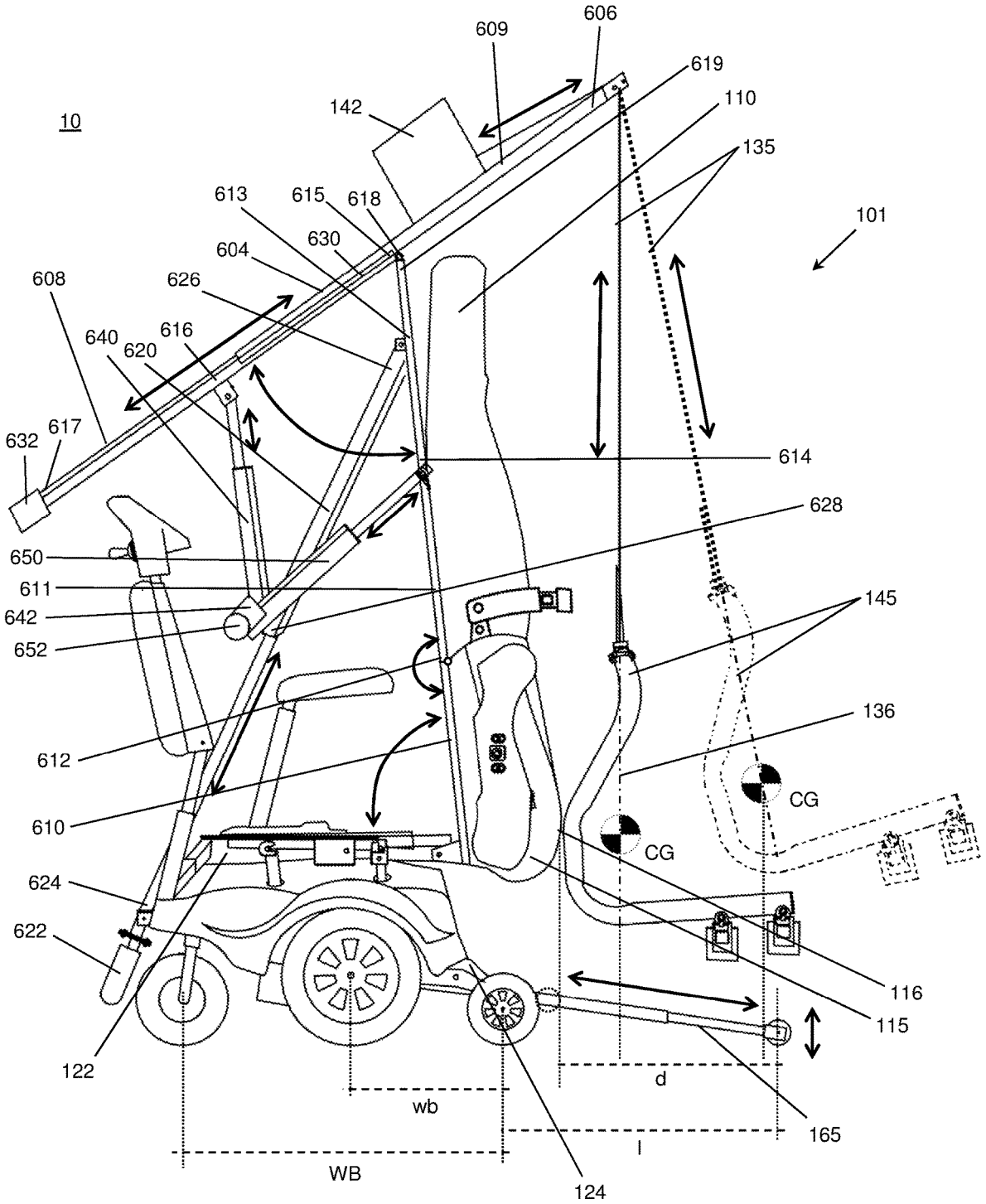
Figure 6C:
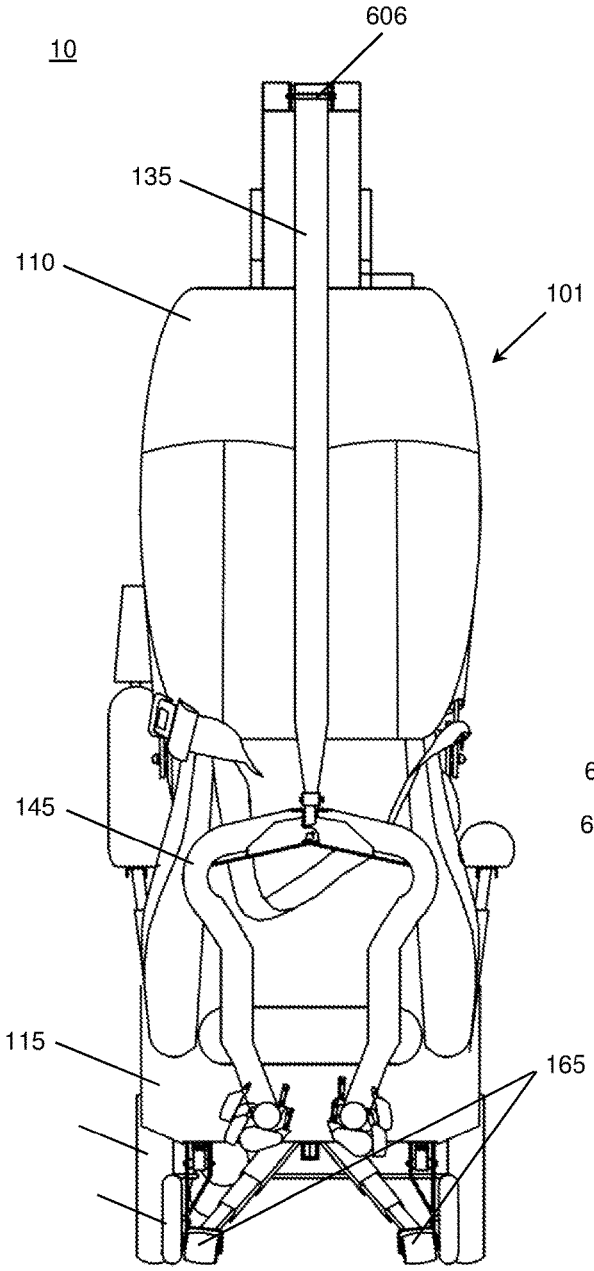
Figure 6D:
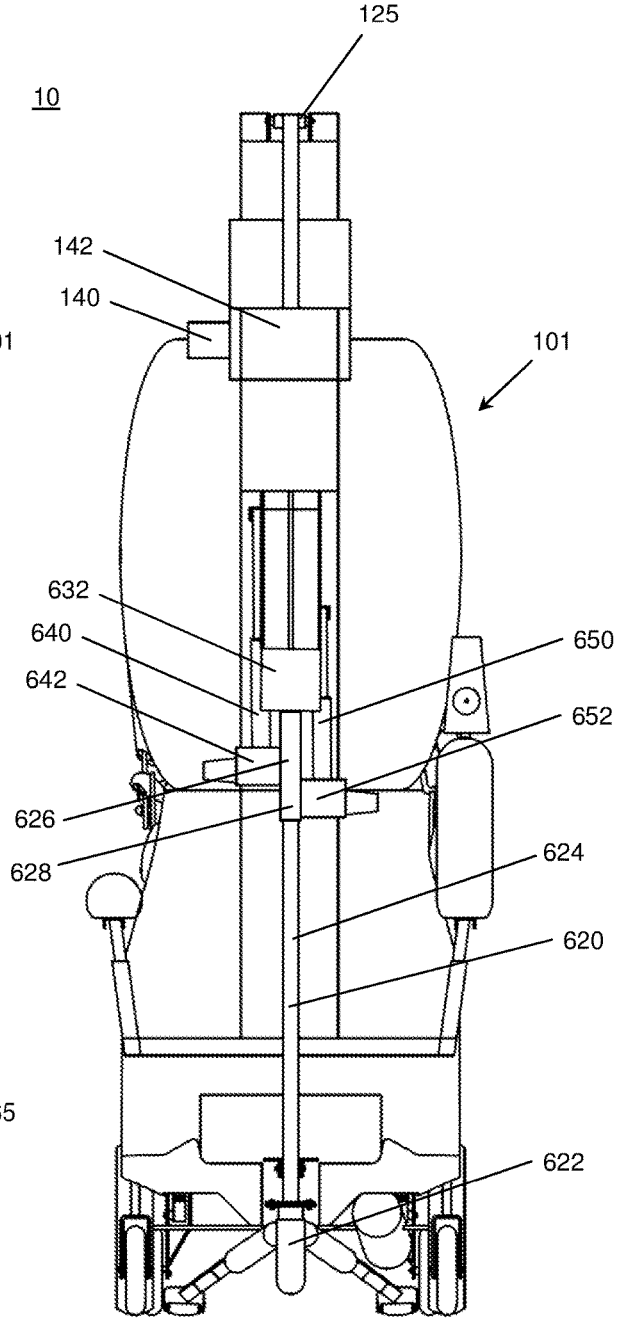
Figure 6E:
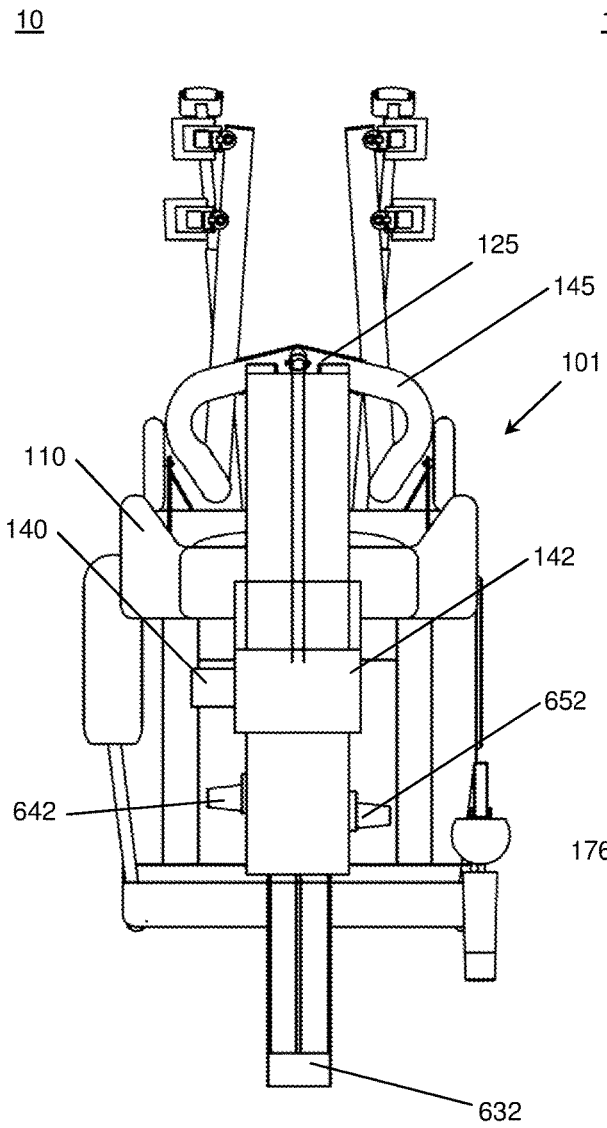
Figure 6F:
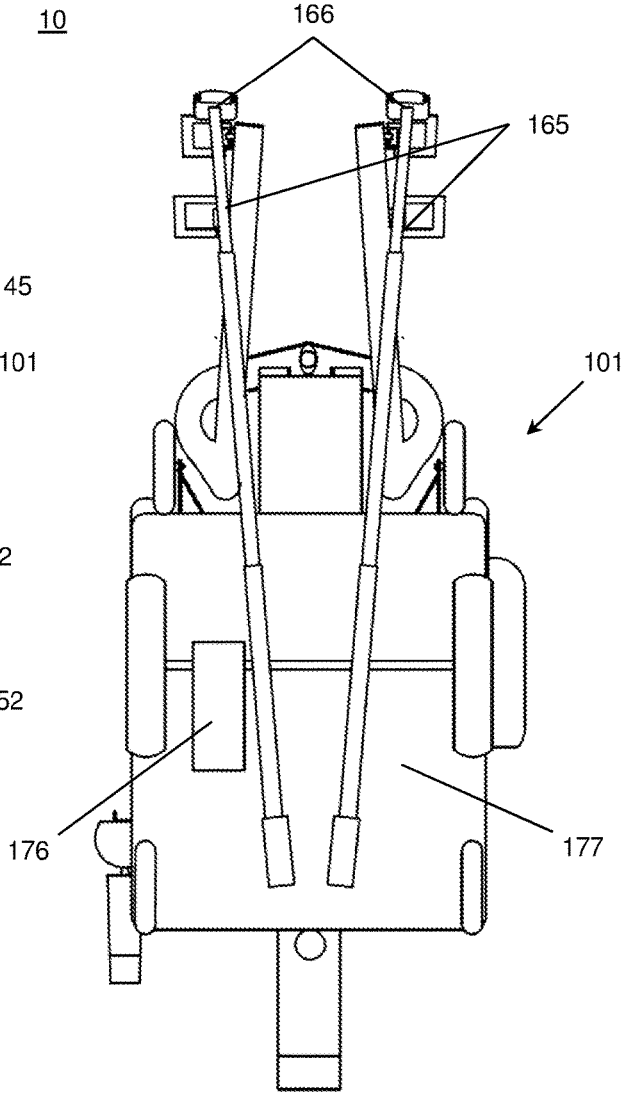
Figure 7:
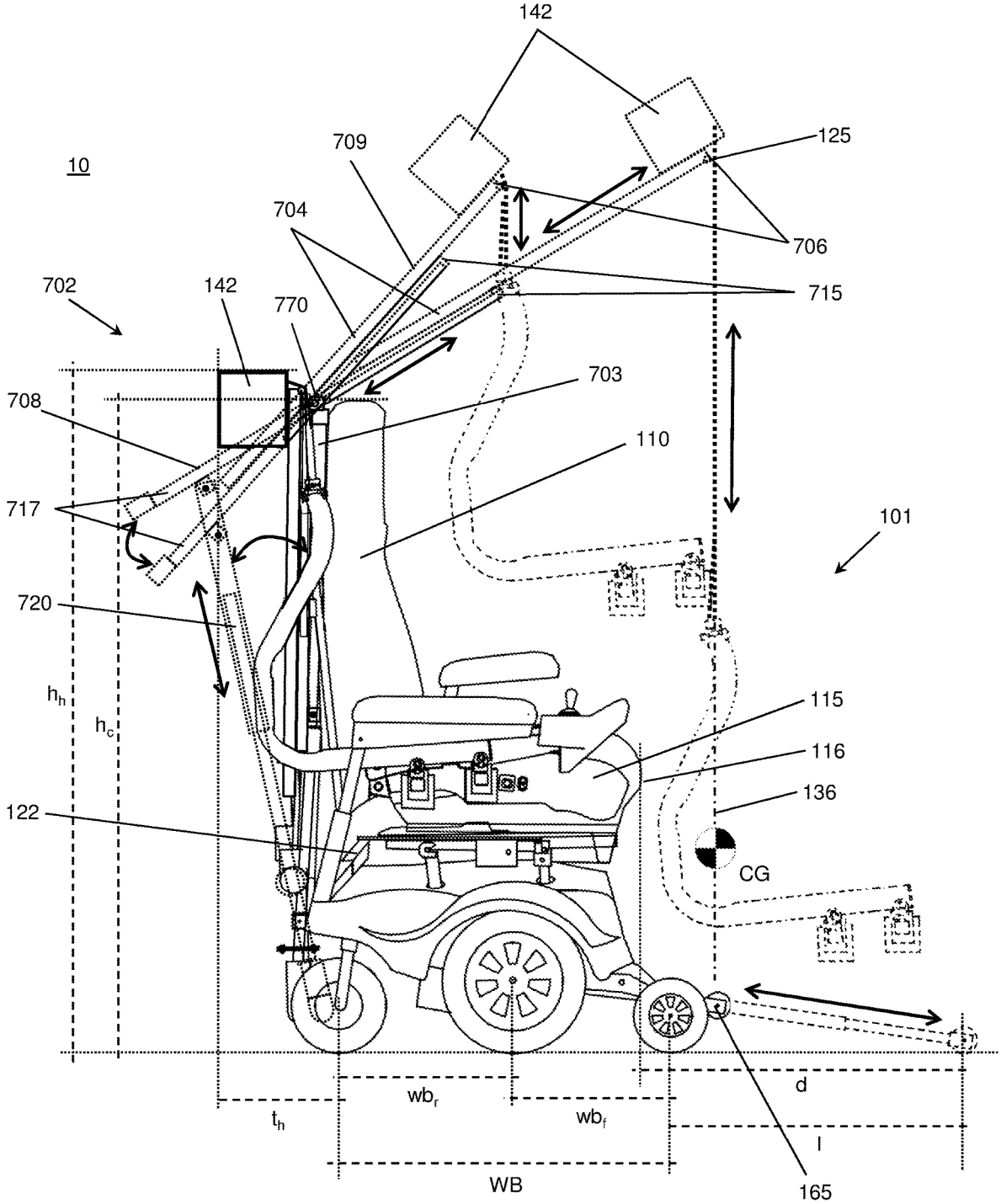
FIG. 7 is a side view of an exemplary motorized wheelchair with an attached hoist, in accordance with a fourth embodiment of the present invention.

FIG. 1 is a side perspective view of an exemplary mobility chair 10 that has a motorized wheelchair 101 and an attached hoist 102, in accordance with a first embodiment of the present invention. Motorized wheelchair 101 may comprise means for raising a seatback 110 and a seat bottom 115 from a standard seating configuration as shown in FIGS. 3A, 6A, and 7 to an upright standing configuration which a substantially vertical orientation of seat bottom 115 and seatback 110 as illustrated in FIGS. 1 and 6B. In the standard seating configuration, seat bottom 115 has a substantially horizontal orientation and seatback 110 has a substantially vertical orientation, and in the upright standing configuration, seat bottom 115 is substantially aligned with seatback 110 in the substantially vertical orientation.

When seatback 110 and seat bottom 115 are raised, hoist 102 extends from a base 120 of wheelchair 101 in an operative configuration as shown in FIG. 1. Hoist 102 may comprise a mast 103 and a boom 104 that may extend up and out to the front of seat bottom 115. A movable linkage 130 comprising two parallel bars 131 and 132 and a connecting bar 133 may connect hoist 102 to chair base frame 122. The moveable linkage 130 may be power adjustable to enable hoist 102 to be raised and lowered along with seatback 110 and seat bottom 115. Movable linkage 130 may also retract and fold into wheelchair 101 when seatback 110 and seat bottom 115 are lowered to provide hoist 102 with a low profile stowed configuration with mast and boom in a fully retracted position behind seatback 110 such as shown in FIGS. 6A and 7. It may be beneficial for seatback 110 to be somewhat tall to create more area for the storage of hoist 102 in the stowed configuration.

The function of raising seatback 110 and seat bottom 115 by linkage 130 may be powered by multiple actuators. These actuators may be attached to one or both of parallel bars 131 and 132. In some embodiments the actuators may perform different functions. For example, without limitation, an actuator attached to parallel bar 131 may be able to lift hoist 102, seatback 110, and seat bottom 115 into a raised position while an actuator attached to parallel bar 132 can tilt the seatback 110 forward or backward when there is a hinge 134 between parallel bar 131 and mast 103. In such a configuration, it will be appreciated that parallel bar 131 can be a panel or other structural support member that is fixed to seat bottom 115 and serves as a lower end of mast 103 while an upper end of mast 103 above the hinge can be a panel or other structural support member that is fixed to seatback 110. The actuators may be powered by battery-operated motors which may have their own batteries or may use power from the same battery or batteries 177 which operate a drive motor 176 for the powered wheelchair 101. The motors incorporated into the actuators may turn gears that power threaded shafts that may extend and retract the actuators. In some embodiments the ratio of the number of revolutions of the motors powering the actuators compared to the number of revolutions of the threaded shafts may be calibrated to help ensure that the actuators are powerful enough to move the loads that the actuators are expected to move and that the actuators typically have the capability to hold the same load in any position in which the load is stopped.

A boom actuator 105 can adjust an orientation of boom 104 relative to mast 103. Boom actuator can move forwardmost end 106 of boom 104 from the fully retracted position behind seatback 110 when hoist 102 is in the stowed configuration such as to a fully extended position as shown in FIG. 1 with winch line 135 hanging along a vertical lift axis 136 ahead of front portion 124 of base frame 122 when hoist 102 is in the operative configuration. Forwardmost end 106 of boom 104 extends ahead of a forwardmost section 116 of seat bottom 115 in the fully extended position, and a rearward portion 107 of boom 104 is located behind mast 103 when forwardmost end 106 of boom 104 is in the fully extended position. Linkage 130 may also modify the tilt of the seatback 110. For example, without limitation, when in an upright standing configuration, linkage 130 may enable seatback 110 to be tilted forward to extend the outward reach of mast 103 and boom 104 or to lower mast 103 and boom 104 towards the floor. In addition, when seatback 110 and seat bottom 115 are lowered, linkage 130 may enable seatback 110 to tilt backward into a reclining position. In some embodiments the mechanism that performs the seat raising function may comprise two linkages with each linkage being slightly off of center or all the way to each outside edge of the wheelchair. For rotation of seat bottom 115 relative to base frame 122, a front section 117 of seat bottom preferably has a hinge bracket 118 that rotatably connects parallel bar 131 to base frame 122.

As indicated above, hoist 102 has a stowed configuration and an operative configuration. Hoist 102 can include a telescopic boom in which the forwardmost end moves from a retracted position behind seatback to an extended position past front of seat bottom when hoist is in the operative configuration. For example, hoist 602 described below with reference to the third embodiment of the present invention as shown in FIGS. 6A-6F has a telescopic boom 604. As yet another example, hoist 702 shown in FIG. 7 is another alternative version of a hoist that has a low profile stowed configuration which has a boom that is raised on boom and rotated and translated forward relative to boom into the operative configuration. It is contemplated that some embodiments may be implemented in which seat bottom 115 and seatback 110 may not need rotate into an upright standing configuration for hoist to be moved into its operative configuration, such as in FIG. 7 where there is sufficient clearance for boom at the top of mast to extend up and over the topside of seatback. In the alternative embodiments, hoist may be attached to base frame of wheelchair with a single hinged connection point with a top end connected to seatback or attached to base frame with a rigid connection point if seatback and seat bottom can rotate on their own apart from the operation of hoist.

In the first embodiment, a winch line 135 may be attached to a winch 140 near the connection between mast 103 and boom 104. As explained in detail below with regard to FIGS. 6A-6F and FIG. 7, for telescopic booms 604, 704, winch 140 is preferably connected to the translating distal segment and may be positioned back from forwardmost end 106 or may extend over forward most end 106. Winch line 135 may be long enough to extend to floor level. Winch line 135 may travel inside mast 103 and/or boom 104, and the interior of mast 103 and boom 104 may be constructed to typically prevent fraying of winch line 135. It is contemplated that winch line 135 may be made of a multiplicity of suitable materials including, without limitation, woven straps, plastic straps, metal cable, rope, chain, etc. Straps may be a desirable option as straps may be less apt to twist while winding on the spool of winch 140. In some alternate embodiments, the winch line 135 may travel along the outside of mast 103 and boom 104. Preferably, a sheave, cylindrical roller, or other circular rotating structure 125 is positioned at the forwardmost end of boom 104 to allow for a smooth, low-friction movement of the winch line around the forwardmost end. A larger diameter sheave (pulley wheel), cylindrical roller, or other circular rotating structure could also be used to increase the turning radius of winch line 135 around forwardmost end 106 of boom 104. Winch 140 supplies the action of extending and retracting winch line 135 to lift or lower an individual. Winch 140 is typically motorized with a winch motor 142 which extends and retracts winch line 135 relative to winch 140. However, there may be some instances in which winch 140 may be manually powered. For example, without limitation, in the case of a malfunction of the power source, winch 140 may be manually operated to lower an individual for emergency purposes.

A sling 145 may be attached to the end of winch line 135 opposite winch 140 to provide a connection point to the individual to be lifted. Sling 145 may be connected to winch line 135 so that sling 145 may freely rotate 360 degrees or more using various different types of connections including, without limitation, ball and socket joints or swivel joints. Sling 145 may comprise a hinge 150 near the connection to winch line 135 which may enable the width of sling 145 to be widened or narrowed to accommodate individuals of different sizes. Sling 145 may comprise a horizontal member 155 at each end which an individual may place under his armpits in order to be lifted by sling 145. In some embodiments these horizontal members 155 may be padded for comfort. In some embodiments these lifting members may have various different shapes including, but not limited to, hooks, flat plates, balls, etc. Those skilled in the art will readily recognize, in light of and in accordance with the teachings of the present invention, that various different types of slings or positioning devices may be used in other embodiments such as, but not limited to, slings made of straps or fabric, belt type positioning devices, devices that the individual being lifted may grip with his hands, etc. For example, without limitation, sling devices may be as simple as a piece of fabric with attached straps which may surround the patient and connect to a lifting point. Such slings and positioning devices may be constructed of many different materials, such as, but not limited to, plastic, steel, other metals, wood, fiberglass, etc. In some embodiments, the sling or other device for connecting an individual to the hoist may be designed so that the individual may attach the sling by himself. In other embodiments the sling may be designed so that a caregiver may need to help the individual connect to the sling. Sling 145 may be stored on or incorporated into seatback 110. This may enable sling 145 to remain available and in position. It is contemplated that in some embodiments, sling 145 may be removed from wheelchair 101 when not in use. Furthermore, in some embodiments, when removed from wheelchair 101, sling 145 may be used on other devices such as, but not limited to, stand-alone lifts or overhead rail systems.

Wheelchair 101 may comprise multiple safety devices. For example, without limitation, one or more straps 160 may be provided to secure the individual to seatback 110 and/or seat bottom 115. In addition, in some embodiments, straps may be provided to secure the individual to sling 145. In some embodiments the safety straps on the sling 145 may be able to retract similar to a seatbelt in an automobile so that the straps may be in a secure and unobtrusive place when not in use rather than hanging loose where the straps may become tangled with each other, an individual or other equipment. It is contemplated that there may be a multiplicity of suitable locations on sling 145 where it may be beneficial to attach this type of safety strap. For example, without limitation, in one embodiment a retractable strap may be connected to one of horizontal members 155. This strap may comprise a buckle or other type of connector that may enable the strap to be pulled from the retracted position and attached to the other horizontal member 155. This may typically cause the strap to be secured around the chest of the individual connected to sling 145. In another embodiment, a strap may be used that would surround the patient near the elbows to typically ensure that the patient's arms do not raise upward as the patient is being lifted to help prevent the patient from slipping out of the sling. This strap would probably not be attached to the sling since, while the sling is positioned upon the patient, most of the sling would be above the point of the arms which may benefit from this support. In the present invention, one or more level sensors may be incorporated into wheelchair 101 to warn of unsafe operation and possibly lock out powered operations if warning is not heeded. These level sensors may return power to the lifting operation once the levelness is within a safe perimeter.

It is contemplated that wheelchair 101 may comprise some structural reinforcements to compensate for the load demands which may be placed upon wheelchair 101 from the lifting of an individual. Some such reinforcements may include, without limitation, a sturdy base structure capable of supporting such stresses, materials of an appropriate gauge or density to support such stresses, reinforcing frames within the cushioning of seat bottom 115 and seatback, etc. In addition, one or more outriggers 165 may be connected to base frame 122 and extend from a retracted configuration to an extended configuration as shown in FIG. 1. In the present invention, outriggers 165 may provide stability to wheelchair 101 during the lifting of an individual on sling 145 to help prevent wheelchair 101 from becoming unstable and tipping forward. Because of this added stability, outriggers 165 may also increase the lifting capacity of wheelchair 101.

Outriggers 165 may be attached to the underneath frame 122 of base 120 and preferably extend some distance beyond the center of gravity (CG) of the load being lifted. In addition, safety wheels 170 may be connected to a front portion 124 of base frame, preferably ahead of powered drive wheels 175 to add stability to base 120. The structure of wheelchair 101 may be involved in the placement and function of outriggers 165. For example, without limitation, in some embodiments in which the overall wheelbase (WB) of wheelchair 101 is longer, the outriggers may be shorter or may be mounted closer to the front of the wheelchair. In the present invention, outriggers 165 may be able to telescopically retract beneath base 120 and extend outward from base 120. This extending and retracting function may be operated by powered actuators. Outriggers 165 may be located in such a position to typically avoid contact with the feet or legs of an individual seated in wheelchair 101 while being extended. It is contemplated that, when fully extended, outriggers 165 may not exceed the width of the wheels of wheelchair 101 to typically enable outriggers 165 to be used in a limited space such as, but not limited to, a hallway or a doorway into a room. The movement of outriggers 165 may be controlled by a computer or similar device to typically insure that outriggers 165 are employed as needed to lift the load safely. Generally, a distal end 166 of each outrigger 165 is proximate to the safety wheels and is below the front portion of the base frame in the retracted configuration. A length (l) between front portion 124 of base frame 122 and distal end in the extended configuration is greater than a front wheelbase (wbf) between drive wheels 175 and the safety wheels 170 and is also greater than a rear wheelbase ($wb_r$) between drive wheels and turning wheels 172. Although it is possible for length (l) to be greater than overall wheelbase (WB), it is not generally required for most operations and is greater than the length of seat bottom 115.

Further, distance (d) is also greater than the front wheelbase and the rear wheelbase and is almost as great as the length of seat bottom to provide adequate clearance away from forwardmost section 116 of seat bottom when hoisting a person from the ground in front of wheelchair.

At distal end 166, contact points between outriggers 165 and the floor or supporting surface may comprise a coating or pad that may help prevent damage to the floor. These pads or coatings may also serve to protect outriggers 165 from damage if used on an abrasive surface, such as but not limited to, gravel or concrete. In some embodiments, these pads or coatings may be of larger diameter than the actual surface of outriggers 165 which may enable outriggers 165 to support a load being lifted on a soft surface such as, but not limited to, dirt or grass. In addition the pads or coatings in some embodiments may be made of a non-stick type material similar to Teflon™ to help enable wheelchair 101 to be moved short distances while outriggers 165 are extended, for example, without limitation, backing outward from lifting a patient from a bed to increase the distance available for the patient to stand by the edge of the bed or moving wheelchair 101 closer to a bed as a patient is being placed into the bed. In some embodiments outriggers 165 may comprise leveling jacks which may adjust the connection points between outriggers 165 and wheelchair 101 or outriggers 165 and the floor to help level wheelchair 101 on uneven surfaces.

Some embodiments may comprise an actuator at the mounting point of outriggers 165 at the front or rear of wheelchair 101 that may be able to adjust the height of outriggers 165 relative to the base frame and front wheels of wheelchair 101 to compensate for a surface that is not level. This actuator may also enable outriggers 165 to be fully extended prior to coming in contact with the floor. It is contemplated that the actuator or actuators controlling the extension and angle of outriggers 165 may be controlled by a computer or similar device to typically ensure that outriggers 165 are employed properly to stabilize the wheelchair 101. Outriggers 165 may be positioned close enough to the floor to typically enable outriggers 165 to be placed under a bed or similar object from which an individual may be lifted. In some embodiments, such as, but not limited to, the embodiment illustrated by way of example in FIGS. 3A and 3B, additional outriggers may be placed on both sides of the wheelchair to help prevent the wheelchair from tipping to either side. Removing outriggers 165 or to retracting outriggers 165 while hoist 102 in use may render the lifting functions of wheelchair 101 unsafe and may restrict the overall mobility capabilities of wheelchair 101.

Some wheelchair embodiments may be implemented without wheels in the front, such as safety wheels 170 and may only have turning wheels 172 in the back of wheelchair 101 that are rotatably attached to base frame 122. For example, without limitation, in one such embodiment the power driven wheels may be located with the leading edges in alignment with the front edge of the seat while the seat is in a raised position. The alignment in such an embodiment may eliminate the need for safety wheels since the center of gravity of the wheelchair may be closer to the load to be lifted and the weight or counterbalance leverage of the wheelchair to compensate for the load being lifted may be increased. Although it is possible for turning wheels 172 that are behind drive wheels 175 to also serve as safety wheels 170, as with some current powered wheelchairs, this is not preferred because it is best if the weight of powered drive wheels 175 are towards the center or back of the wheelchair. Some wheelchairs have a single turning wheel at the rear, and in this case, safety wheels may be required.

Of course, with the distal ends of extendable outriggers being ahead of the center of gravity of the person (CG) being lifted minimizes the risk of wheelchair being toppled, and keeping the weight of wheelchair as far back as possible helps to function as a counterweight when a person is moved from the wheelchair to another location and the CG moves close to or slightly ahead of the outriggers' distal ends. Accordingly, when referring to safety wheels 170 being in front of powered drive wheels, it will be appreciated that an equivalent embodiment, although less preferable, would have safety wheels behind the powered drive wheels.

Wheelchair 101 and its various powered functions may be operated by pushing buttons or activating other types of controls on a control panel located on wheelchair 101. Those skilled in the art will readily recognize, in light of and in accordance with the teachings of the present invention, that this control panel may comprise a multiplicity of suitable types of controls such as, but not limited to a joystick for guiding the movement of wheelchair 101, levers or toggles for changing the incline of seatback 110, or dials for raising and lowering seat bottom 115 or hoist 102. A hand controller 178, such as described in U.S. Pat. No. 10,386,936 by Stucki et al. which is incorporated by reference, can be attached to one of the wheelchair's armrests for use by the person when sitting in the wheelchair or may extend through a cord for use when a person is out of the wheelchair. Furthermore, in some applications a remote controller, which may be wired to wheelchair 101 or wireless may be used to control the various functions of wheelchair 101. It is contemplated that these powered functions may be controlled by electronic controllers which receive input from sensors and switches so the functions may be monitored to typically avoid unsafe operations. In the present invention, the powered functions may be operated by a caregiver or, if the abilities of the individual being moved by wheelchair 101 allows them control, may be operated by this individual. Braking and parking functions may be controlled by the powered drive motors of wheelchair 101. In some embodiments mechanical brakes such as, but not limited to, wheel locks may be used in conjunction with the powered braking and parking functions. When the drive motors are not powered it is typically very difficult to move wheelchair 101, but these motors can be disengaged by a lever, which may suspend the control for parking or braking. Therefore, when a patient is in wheelchair 101 this disengagement typically would not be performed except for those wheelchairs which have a manually operable brake or wheel locks, such as an emergency brake, and there is one or more able-bodied individuals available to assist in securing the wheelchair 101 from unintended movement.

In typical use of the present invention, wheelchair 101 may be used to move an individual from one place to another place without the effort of walking. The movement of the individual may include transferring the individual into or out of wheelchair 101 as well as travelling from place to place while sitting in wheelchair 101 similar to a traditional powered wheelchair. To transfer an individual from one location to another, hoist 102 may be positioned so that mast 103 and boom 104 may be capable to reach approximately 7 and ½ feet in height at a point approximately 1 and ½ feet to 2 feet in front of raised seatback 110. This may enable sling 145 to rotate 180 degrees without hitting the raised seatback 110 and may enable the components of hoist 102 to lift sling 145 and the individual being lifted high enough to clear the floor. Being able to rotate 180 degrees in front of wheelchair 101 may enable the individual to transition from a bed or other location into wheelchair 101 or to transition from wheelchair 101 to sit on a bed, to sit on another chair, to sit on a toilet, to get into a bath tub.

Some alternate embodiments may be implemented with various different heights and lengths of hoist 102 to accommodate for a variety of factors such as, but not limitation, the overall size of the wheelchair, the size of the patient, and the type of lifting being done. To transfer an individual from a bed to wheelchair 101, outriggers 165 may be extended so that they reach under the bed. Outriggers 165 might not need to be employed as an individual is being placed into a tub, into another chair, or on a commode. Most commodes have a narrow base which outriggers 165 may typically be able to straddle, and in these cases it is advisable to use outriggers 165. However, some commodes may have bases which may interfere with operation of the outriggers. Furthermore, bath tubs or other chairs such as, but not limited to, recliners may interfere with the operation of outriggers as well. In these cases wheelchair 101 may be placed very close to the object and monitoring devices examining the positioning of wheelchair 101 may be employed to typically ensure a safe transfer without the use of outriggers 165. Once wheelchair 101 is in place, the individual may be positioned at the edge of the bed and horizontal members 155 of sling 145 may be positioned under the individual's armpits. If safety straps are included on sling 145, these straps may be employed to secure the individual to sling 145. Then the individual or a caregiver may operate winch 140 to raise sling 145 along with the attached individual until the individual is raised above the floor. The individual or caregiver may then rotate the individual to the appropriate location to be positioned against raised seatback 110 and seat bottom 115, and strap 160 may then be fastened. The individual or caregiver may then use the controls to lower seat bottom 115 and seatback 110 to sit down in wheelchair 101. Outriggers 165 may then be retracted under base 120, and sling 145 may be disconnected from the individual and stowed in a position provided on seatback 110. The individual or caregiver may then use wheelchair 101 to transport the individual to the desired location.

If the individual is being transferred from wheelchair 101 to another place, for example, without limitation, into another chair, the process is similar. The individual may be attached to sling 145 by placing the horizontal members 155 under the individual's armpits and attaching any safety straps to secure the patient while seated in wheelchair 101. Then seat bottom 115 and seatback 110, along with hoist 102, may be raised so the individual is in a standing positioned. Strap 160 may be employed to hold the individual near seat bottom 115 and seatback 110 while linkage 130 is raising these portions of wheelchair 101. Strap 160 may then be released so winch 140 can be used to raise sling 145 and the attached individual to a height that will allow rotation even if the patient's feet are still on the on the floor or suspended above the floor. Then the individual may be rotated into position over a seat which is in front of wheelchair 101 so winch 140 may be operated to lower the individual into this chair in front of wheelchair 101. Once the individual is in place, sling 145 may be removed from the individual and returned to its storage position in seatback 110 of wheelchair 101. If the individual is being lifted from a bed, the end of boom 104 may be extended beyond the front of seat bottom 115 to be able to reach near the center of the bed. Once positioned, sling 145 may be lowered down to the surface of the bed and placed under the individual so that horizontal members 155 may be located under the shoulders and under the armpits of the individual. Then a safety strap that is attached to sling 145 may be employed to secure the individual to sling 145. The individual may be lifted from a lying position into a seated position by raising sling 145 with winch line 135 and winch 140. In this seated position hinge 150 may enable horizontal members 155 to move inward to apply pressure to the ribcage of the individual. In some embodiments, such as but not limited to the embodiment illustrated by way of example in FIGS. 2A through 2C, this inward pressure may be controlled by adjusting the tension of the hinge. The individual may then be lifted enough to be located at the edge of the bed where the feet can be off the edge of the bed. Wheelchair 101 may continue to lift the individual into a standing position in front of wheelchair 101. Then the individual may rotate himself or may be rotated with the help of a caregiver to face away from wheelchair 101. The individual may be lowered into seat bottom 115 as wheelchair 101 is returned into a lowered position. Placing the individual back into the bed may be accomplished by reversing these steps. These capabilities would serve to almost completely eliminate the stress normally incurred by a caregiver while moving an individual.

It is believed that many benefits may be obtained by some embodiments of the present invention. For example, without limitation, many embodiments may be operated by a single individual, even the individual being moved with the aid of a remote controller. Some embodiments may be implemented to traverse terrain that would be nearly impossible for conventional power lifts and may be as mobile as many power chairs currently available. In some applications a chair similar to wheelchair 101 described in the foregoing may be able to replace overhead rail systems in homes, hospitals, and other patient care facilities. Many embodiments may help to reduce caregiver injuries which may be caused by strenuous activities involved in moving patients. Furthermore, it is believed that an individual may typically be suspended by the sling for a short period of time when being lifted by a device similar to wheelchair 101.

In another exemplary use of the present invention, wheelchair 101 may also be used for retrieval of patients who have fallen. In this application winch 140 may be operated to lower sling 145 to floor level. Outriggers 165 may or may not be extended depending on the positioning of the individual as wheelchair 101 may need to be close to the individual. Sling 145 may then be placed under the shoulders of the individual to start the lifting process. As the upper torso of the individual is lifted, sling 145 may be rotated into position under the armpits and wheelchair 101 may be moved to center the individual under boom 104. Winch 140 may then continue to lift the individual until the individual is raised from the floor. If not already extended, as the individual is being lifted and weight is being transferred to wheelchair 101, outriggers 165 may be employed to help ensure stability. In yet another exemplary use, wheelchair 101 may be used to hold an individual in a lifted position while being dressed as this position may provide freedom from obstructions to dress the lower portion of the individual. Then even if the individual is very weak, seat belt strap 160 may be employed to hold the individual to seat bottom 115 and seatback 110 in an upright standing configuration so that sling 145 may be loosened enough to be of little obstruction for dressing the upper torso. In many cases the upper torso may be dressed prior to or after being lifted to dress the lower portion of the individual.

In yet another exemplary use, sling 145 may be disconnected from hoist 102 so that hoist 102 may be used to lift objects that may be too heavy for an individual to lift such as, but not limited to, furniture, bags of supplies, and laundry. These objects may then be lowered into seat bottom 115 to be transferred to another location. For example, without limitation, this application may be used to move groceries from a vehicle into a kitchen.

Figure 2A:
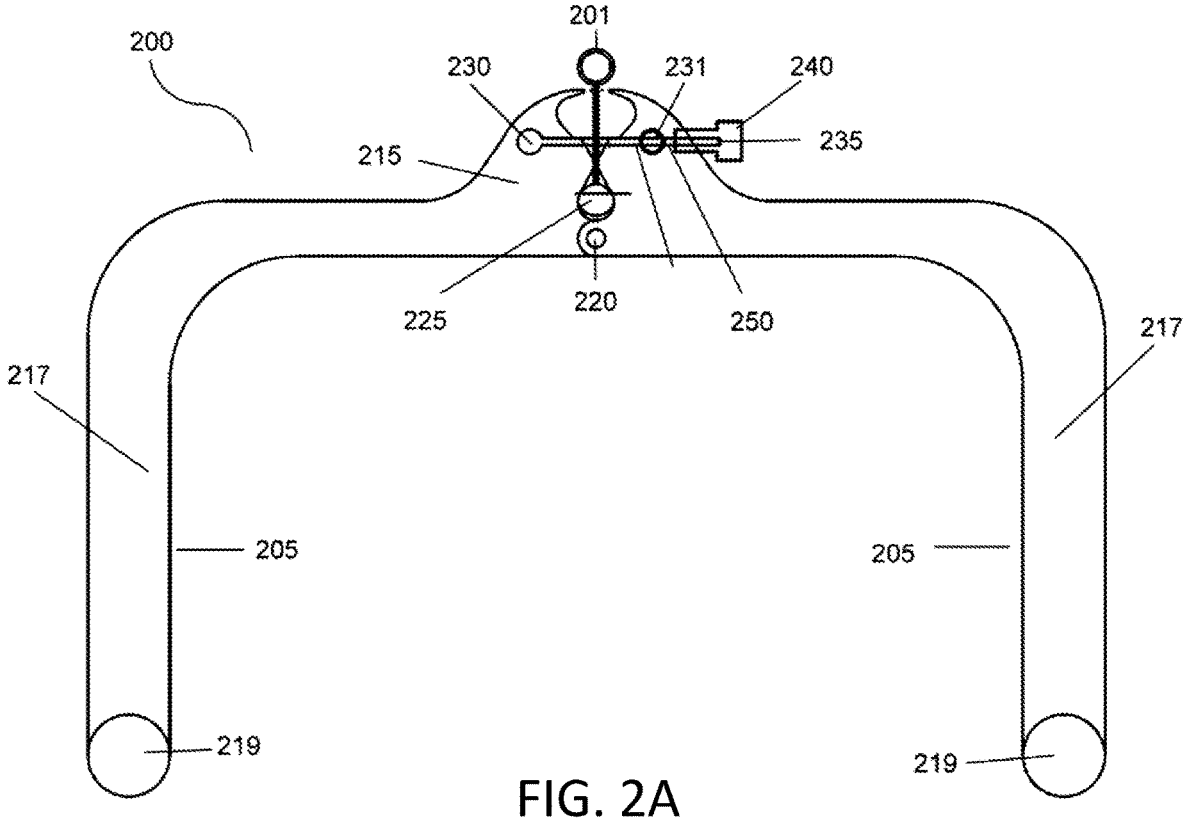
FIGS. 2A, 2B, 2C and 2D illustrate an exemplary sling for a patient hoist that can be used with any embodiment of the motorized wheelchair.
Figure 2B:
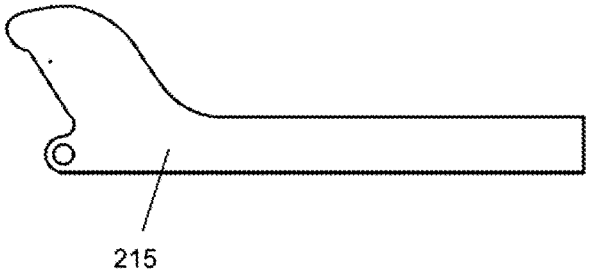
Figure 2C:
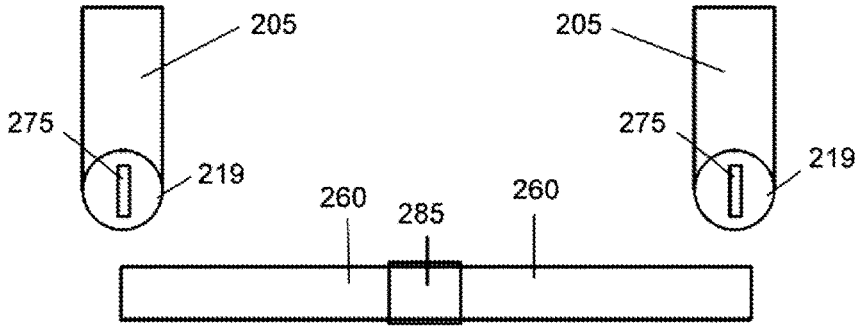
Figure 2D:
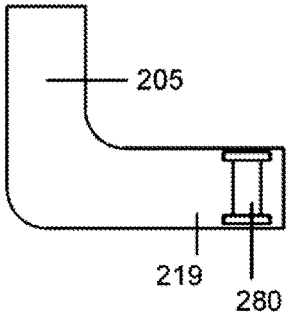

FIGS. 2A, 2B, 2C and 2D illustrate an exemplary sling 200 for a patient hoist, in accordance with an embodiment of the present invention. FIG. 2A is a transparent front view of sling 200. FIG. 2B is a diagrammatic front view of a cam plate 215. FIG. 2C is an exploded front view of a lower portion of sling 200 with a retractable safety strap 260, and FIG. 2D is a transparent side view of the lower portion of sling 200 with retractable safety strap 260. Sling 200 is similar to sling 145, shown by way of example in FIG. 1, and sling 200 may be used in conjunction with a patient hoist connected to a motorized wheelchair in a similar manner. Referring to FIGS. 2A and 2B, sling 200 comprises arms 205 connected by a pivot pin 220. Arms 205 may be formed as one piece structures comprising cam plates 215 and extended portions 217. At the end of each extended portion 217 may be a horizontal member 219.

In typical use, an individual may be lifted by sling 200 by hooking his armpits over horizontal members 219. Then the two cam plates 215, which face each other, may be moved by a lifting pin 225 as lifting pin 225 is lifted by a lifting eye 201. Bushings may be located on lifting pin 225 between lifting pin 225 and cam plates 215 to aid in this movement. When lifting pin 225 is lifted by lifting eye 201 the upper portions of cam plates 215 may be pulled apart while the lower portions of cam plates 215 may remain anchored by pivot pin 220. The pivoting action of cam plates 215 around pivot point 220 typically causes extended portions 217 of arms 205 to move inward to apply pressure to the ribcage of the attached individual. The amount of pressure applied to the individual may be controlled by a load adjuster attached to cam plates 215 at connection points 230 and 231. A threaded rod 235 extends from connection point 230 through a slip joint at connection point 231 and then to an adjustment knob 240. The outward movement of cam plates 215 pulls connection points 230 and 231 apart along threaded rod 235 until a seat 250 on connection point 231 reaches adjustment knob 240. This typically stops the movement of cam plates 215 and therefore stops the inward movement of extended portions 217 of arms 205.

Referring to FIGS. 2C and 2D, the ends of arms 205 of sling 200 may be bent at an angle of 90 degrees to form horizontal members 219 that may serve as the lifting points for an individual when placed under the armpits. Horizontal members 219 each comprise a slot 275 in the front and a spool 280 inside. Strap 260 may retract into horizontal members 219 through slots 275 and onto spools 280. Spools 280 may comprise spring loaded mechanisms that may enable strap 260 to more easily retract into horizontal members 219. Strap 260 may be formed as two portions, one for each arm 205, with one portion comprising a buckle assembly 285, which may enable the portions of strap 260 to be separated and reattached as needed. In typical use, strap 260 may be used to secure the individual to the sling. Easy access to and storage for straps 260 may also be provided. It is contemplated that alternate embodiments may be implemented with safety straps that do not retract back into the arms of the sling. In such embodiments the straps may be connected to the sling when needed by various different means such as, but not limited to, screws, bolts, clips, buckles, or channels. In other alternate embodiments patient slings may be employed without safety straps.

Figure 3B:
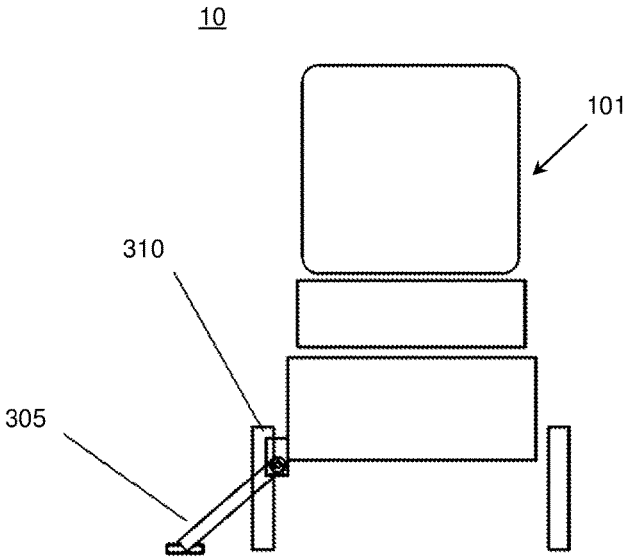

FIGS. 3A and 3B illustrate an exemplary motorized wheelchair with a retractable outrigger 305 attached to the side, in accordance with a second embodiment of the present invention. FIG. 3A is a diagrammatic side view, and FIG. 3B is a diagrammatic front view. Outrigger 305 may be placed behind a powered wheel 310, which is similar to powered drive wheels 175 shown by way of example in FIG. 1. In some embodiments there may be one such outrigger on each side of the wheelchair. Such outriggers may be employed as needed to help ensure that the wheelchair does not tip to either side if lifting an individual on an uneven surface. Outrigger 305 may be hinged to be retracted when not in use as illustrated by way of example in FIG. 3A.

Figure 4:
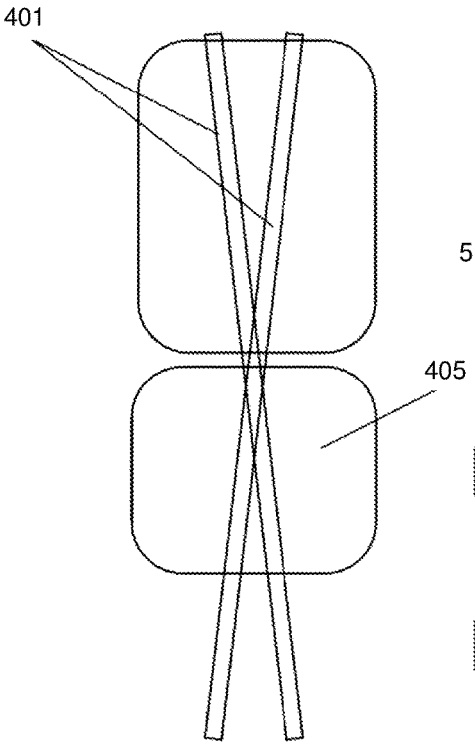
FIG. 4 is a diagrammatic front view of an exemplary strap system that can be used with any embodiment of the motorized wheelchair.

FIG. 4 is a diagrammatic front view of an exemplary strap system 401, in accordance with an embodiment of the present invention. Strap system 401 may be arranged in an X configuration but are not limited to the X configuration and may be used under a patient in a seat 405, similar to seat bottom 115 shown by way of example in FIG. 1, and in conjunction with a sling similar to sling 145 and sling 200 described by way of example in the foregoing to serve as a lifting device similar to safety straps required by OSHA as safety equipment. The straps of strap system 401 may attach to the arms of the sling and may be adjustable in length. Straps 401 and other such straps may be an accessory to a motorized wheelchair with a patient hoist and may not be attached to the wheelchair until needed to provide lifting for a patient.

Figure 5:
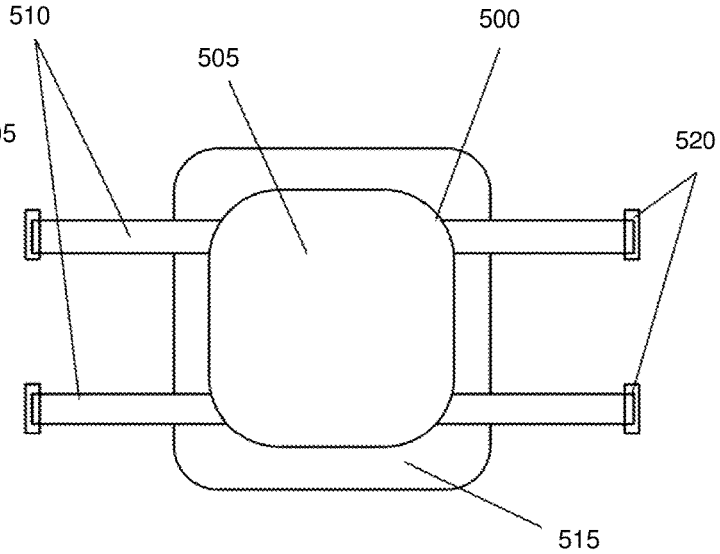
FIG. 5 is a diagrammatic top view of an exemplary sling attachment that may be used with a patient sling in any embodiment of the motorized wheelchair.

FIG. 5 is a diagrammatic top view of an exemplary sling attachment 500 that may be used with a patient sling, in accordance with an embodiment of the present invention. Sling attachment 500 may be configured similar to an H pattern with a wide center connector 505 and four straps 510 attached to center connector 505. Center connector 505 may be placed into a seat 515 of a chair prior to a patient entering the wheelchair. Center connector 505 may be nearly as wide as seat 515 is deep with two straps 510 available on each side of the patient. In addition, center connector 505 may be padded to increase the comfort of the patient. Straps 510 may attach to the horizontal members of a patient sling. Then the patient may be lifted by the sling, which may be attached to a hoist incorporated into a motorized wheelchair, with much of his weight sitting on center connector 505 of sling attachment 500.

Since sling attachment 500 typically enables the patient to be lifted in a sitting position, the weight placed on the armpits or shoulders of the patient may be reduced. It is believed that this may be beneficial for patients who have had shoulder injuries. Sling attachment 500 may be provided as an optional accessory for a motorized wheelchair with an incorporated patient hoist and may not necessarily be attached to the sling when not in use. Several different methods may be used to attach straps 510 to the horizontal portions of the sling. For example, without limitation, straps 510 are shown with buckles or latching devices 520 that may connect straps 510 to the sling. Other methods that may be used to attach straps 510 to a sling may include, without limitation, hooks, clips, or clamps.

FIGS. 6A-6F illustrate a third embodiment of the exemplary motorized wheelchair 101 with another version of a hoist 602. The features of motorized wheelchair 101 and outriggers 165 are mostly the same as wheelchair and outriggers described above with reference to FIG. 1 while hoist 602 has variations as particularly described below. With regard to FIG. 6A, motorized wheelchair 101 is shown in the standard seating configuration with hoist 602 in its stowed configuration and outriggers 165 in their retracted configuration. In FIGS. 6B-6F, motorized wheelchair 101 is shown in the upright standing configuration with hoist 602 in its operative configuration.

Hoist 602 has a mast 603, a telescopic boom 604, a winch 140 with a winch motor 142, and a winch line 135. As in the embodiment described above, sling 145 is connected to the winch through the winch line, and hoist is connected to base frame 122 and/or seatback 110. Telescopic boom has a proximal segment 608 connected to a distal segment 609 that longitudinally translates relative thereto. Winch 140 is connected to and translates with distal segment. Forwardmost end 606 of the distal segment moves between a fully retracted positon behind the seatback when hoist is in the stowed configuration to a fully extended position with winch line 135 hanging along vertical lift axis 136 ahead of front portion 124 of the base frame 122 when hoist 602 is in the operative configuration.

Mast 603 is formed by a bottom panel 610 that is rotatably connected to a back panel 611 through a hinge 612. Seat bottom 115 is fixedly attached to bottom panel, and seatback 110 is fixedly attached to back panel. Hinge bracket 118 attached to front section 117 of seat bottom 115 rotatably connects mast 603 and seat bottom to base frame 122. A threaded rod linear actuator 620 is rotatably attached between hinge brackets fixed to a backside of base frame and to an upper section 613 of back panel. In operation, a screw motor 622 at the bottom of the actuator rotates threaded rod in a nut secured to a telescoping tube to raise and lower seatback relative to base frame, and it will be appreciated that hydraulic actuators and other linear actuators could be used. A lower segment 624 of linear actuator 620 is hingedly connected to base frame and an upper segment 626 of linear actuator is rotatably connected to a forward portion 615 of telescopic boom's proximal segment 608 through its hinged connection to back panel. Another linear actuator 630 is connected between telescopic boom's proximal segment 608 and distal segment 609. A motor 632 operates linear actuator 630 to longitudinally translate distal segment relative to proximal segment.

A boom actuator 640 and motor 642 provides support to telescopic boom 604 and varies the angle of telescopic boom relative to mast 603. Boom actuator is rotatably connected between a lower portion 628 of upper segment 626 of linear actuator 620 and an intermediate portion 616 of telescopic boom's proximal segment 608. Rearward portion 617 of telescopic boom's proximal segment is behind boom actuator which is behind mast 603. As linear actuator 620 raises seatback 110, upper segment 626 of linear actuator 620 moves upward, and forward portion 615 of the telescopic boom's proximal segment moves upward from the base frame with upper segment, and boom actuator rotates telescopic boom forward such that forward portion is positioned vertically above or ahead of drive wheels 175. A hinge 618 is fixed to back panel's upper section 613 proximate to a top end 619 of mast, and telescopic boom's proximal segment 608 is rotatably connected to hinge. In operation, third motor rotates telescopic boom's proximal segment relative to first actuator's upper segment 626 and relative to mast.

A seatback rotation actuator 650 and motor 652 vary the angle of back panel 611 and seatback 110 relative to base frame 622. Seatback rotation actuator is rotatably connected between lower portion 628 of upper segment 626 of linear actuator and an intermediate section 614 of back panel below upper section 613 where linear actuator is hingedly connected. It will also be appreciated that hinge bracket 118 can be actuated and can serve as a seatback rotation actuator. As described above, hinge bracket is attached to front section 117 of seat bottom 115, and bottom panel 610 is rotatably connected to back panel 611 through hinge 612. Accordingly, rotating hinge bracket would rotate bottom panel, and back panel would be rotated by its connection to bottom panel through hinge with a stop when back panel and bottom panel are aligned. With an actuated hinge bracket, it will also be appreciated that rotation of seat bottom 115 and seatback 110 between the standard seating configuration and the upright standing configuration can be performed without any actuation of hoist 602. Accordingly, this seating and standing aspect of the present invention can be incorporated into powered wheelchairs without any hoist unit necessarily being included.

As shown in FIG. 7, another embodiment of a hoist 702, proximal segment of telescopic boom 704 may be engaged by a boom actuator that translates proximal segment 708 forward relative to base frame 122. For example, boom actuator can be a rack and pinion mechanism with a gear actuator 770 positioned at the top of mast 703 that engages the teeth of a rack on boom which moves forward end 715 of proximal segment ahead of seatback 110. Boom actuator can operate while linear actuator 720 pushes upwards on rear end 717 of proximal segment resulting in the raising and forward rotation of proximal segment. In the hoist embodiment described above with reference to FIGS. 6A-6F, forward portion 615 of proximal segment always remains behind mast and seatback, whereas in the hoist embodiment in FIG. 7, forward portion 715 of proximal segment is moved ahead of mast and seatback.

Hoist 702 preferably uses a telescopic boom 704 with distal segment 709 that longitudinally extends forward into the operative configuration. However, hoist does not require a telescopic boom to extend forward of the forwardmost section of the chair. Considering a boom that only has proximal segment 708 shown in FIG. 7 (i.e., no distal segment or telescoping actuator), boom and mast 703 could be raised from behind the seatback 110 of wheelchair 101, and boom could be rotated and extended forward relative to the mast. Telescopic boom distal segment 709 is preferred for vertical lift axis 136 to extend ahead of forwardmost section 116 of seat bottom 115, and in this embodiment, with seat bottom remaining in the seating configuration. In this embodiment, distance (d) is approximately equal to wheelbase (WB) and is greater than length (l) of outriggers 165 and the length of seat bottom 115 which provides more than adequate clearance away from forwardmost section 116 of seat bottom when hoisting a person from the ground in front of wheelchair 101.

It will be appreciated that hoist 702 can be added to a seat that remains in a standard sitting configuration and does not rotate into the upright standing configuration. It is also possible to rotate the seat with a hinge bracket attached to front section of seat bottom as described above. Accordingly, hoist 702 could be mounted directly to base frames of many existing powered wheelchairs with limited modification to the seat assembly and without significant redesign required. Preferably, with a rack and pinion mechanism, gear actuator 770 would be enclosed to help prevent against objects near the top of seatback accidentally getting caught in the mechanism, such as a hat or a person's hair.

As apparent from the description of the hoist embodiments above and the corresponding drawings, the present invention provides significant benefits over current powered wheelchairs that do not have any hoist mechanism and avoids the problems of many prior hoists that have been proposed for powered wheelchairs. In some prior art mobility chairs, the hoist mechanisms would significantly increase the profile of the powered wheelchair; either they would not fold or if they did fold, they extended significantly behind the back of the wheelchair and/or their height would be almost twice the height of the topside of the seatback. In other prior art mobility chairs, the boom is fixed relative to the mast and there is no way to move it forward relative to the front of the frame of the wheelchair; in these fixed boom mobility chairs, there is no way to move the boom forward, not by longitudinal translation nor by rotation nor by any other means or mechanism. In comparison, hoists 102, 602, 702 disclosed with mobility chair 10 of the present invention have booms that can move forward relative to base frame 122 in the operative configuration while also providing for a very low profile when in the stowed configuration.

When hoist 102, 602, 702 is in operative configuration, the actuators work together to extend either boom 104 or telescopic boom 604 so that its distal segment's forwardmost end 106, 606, 706 is moved upward and forward ahead of mast 103, 603, 703 to its fully extended position where vertical lift axis 136 is ahead of forwardmost section 116 of seat bottom 115. Even in the fully extended position, vertical lift axis preferably remains behind outriggers' distal ends 166 when in their extended configuration to help ensure that the center of gravity (CG) of the person being lifted remains within the extended wheelbase (WB+1) of mobility chair 10. Actuators are also operative to fold hoist into its stowed configuration at the back of wheelchair 101 to provide an extremely low profile for nearly the same access and mobility as standard powered wheelchairs that do not include any hoist mechanism because when hoist 102, 602, 702 is in its stowed configuration and forwardmost end of telescopic boom's distal segment is in its fully retracted position behind the seatback, the height and the length of the wheelchair are not significantly impacted. Top end of the hoist in the stowed configuration is in a horizontal plane that is at or below a height that is no more than 120% of the uppermost seat height when the seat bottom and the seatback are in a standard seating configuration with the seat bottom being in a substantially horizontal orientation and the seatback being in a substantially vertical orientation. The uppermost seat height may be the topside of the chair's seatback ($h_c$) or it may be the top end of the mast or it could be the hoist actuator ($h_h$).

It is contemplated that some embodiments of the present invention may be implemented as an accessory that may be added to an existing motorized or manual wheelchair to provide lifting functions. These embodiments may be made available as an aftermarket modification or as removable or permanent accessories. It is further contemplated that various additional features and functions may be implemented into some alternate embodiments such as, but not limited to, adjustable angles of the mast and/or boom, hand grips in various locations, adjustable armrests, adjustable head rests, a control module or remote which overrides any patient accessible controls for the wheelchair or lift, straps or restraints located in different locations to serve for particular patients or purposes, and/or dimensions or weight capacities altered from the original concepts to serve for special needs of some patients. Features of the present invention may also be used to improve the features of prior inventions, such as U.S. Pat. No. 5,409,250 by Gyula Csotonyi which is incorporated by reference herein, although it will be recognized that the changes to the previous inventions will necessarily change its principles of operation and may render aspects of the prior inventions unworkable. However, rather than using linear telescopic members to lift both the seatback and seat bottom 115 together so that a person in the seated position can reach objects that would otherwise be too high to grasp, the improved features of the present invention can lift a person into a partially standing or full standing position where they can reach such objects that are too high to grasp while the person is in a seated position.

Having fully described exemplary embodiments of the present invention, other equivalent or alternative methods of implementing a mobility aiding chair with an integrated patient hoist according to the present invention will be apparent to those skilled in the art. Various aspects of the invention have been described above by way of illustration, and the specific embodiments disclosed are not intended to limit the invention to the particular forms disclosed. The particular implementation of the wheelchair with integrated patient hoist may vary depending upon the particular context or application. By way of example, and not limitation, the wheelchairs described in the foregoing were principally directed to motorized implementations; however, similar techniques may instead be applied to integrating power or manual hoists into non-motorized wheelchairs, which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. For example, although the embodiment of the invention shown in FIG. 7 has a pivot bracket at the top of the back panel that remains in a fixed position relative to the seatback, it will be appreciated that the pivot bracket could be attached to a sliding section on the back panel that could be raised further above the top of the seatback in the operational configuration and could even be pulled slightly below the top of the seatback in the low profile stowed configuration. A raising and lowering mechanism of such a sliding section could be similar to the threaded rod inside telescopic tubing as described with reference to FIGS. 6A-6F. It will also be appreciated that the threaded rod inside the telescopic tubing as described with reference to FIGS. 6A-6F could be fastened to an upper lift column in a telescoping assembly which is moved relative to a lower base column as described in U.S. Pat. No. 5,379,468 by Cassidy et al. which is incorporated by reference herein. Similar to the boom of the crane in the Csotonyi '250 Patent, the boom of the crane in the Cassidy '468 Patent (arm 14) is completely cantilevered when in the fully extended operative configuration and there is no telescoping of the arm boom. Accordingly, persons of ordinary skill in the art will appreciate how the improvements of the present invention applied to the booms of the Csotonyi '250 Patent and the Cassidy '468 Patent would result in beneficial modifications to the cranes in these inventions with some changes in the boom's principle of operation. Thus, the breadth and scope of the present invention should not be limited by any of the above-described exemplary embodiments, but should be defined only in accordance with the following claims appended hereto and their equivalents.

What is claimed is:

1. A mobility chair, comprising:

a wheelchair comprising a base frame, a seat bottom connected to the base frame, a seatback connected to at least one of the base frame and the seat bottom, a pair of drive wheels connected to the base frame, and a pair of safety wheels connected to a front portion of the base frame;

a pair of outriggers connected to the base frame, wherein the outriggers move between a retracted configuration and an extended configuration, wherein a distal end of each of the outriggers is proximate to the safety wheels and is below the front portion of the base frame in the retracted configuration, and wherein a length between the front portion of the base frame and the distal end in the extended configuration is greater than a front wheelbase between the drive wheels and the safety wheels; and a hoist comprising a mast, a telescopic boom, a winch with a winch motor and a winch line, and a sling connected to the winch through the winch line, wherein the hoist is connected to at least one of the base frame and the seatback, wherein the hoist moves between a stowed configuration and an operative configuration, wherein the telescopic boom is comprised of a proximal segment and a distal segment, wherein the distal segment longitudinally translates relative to the proximal segment, wherein the winch is connected to and translates with the distal segment, wherein the winch motor extends and retracts the winch line relative to the winch, and wherein a forwardmost end of the distal segment moves between a fully retracted position behind the seatback when the hoist is in the stowed configuration to a fully extended position with the winch line hanging along a vertical lift axis ahead of the front portion of the base frame when the hoist is in the operative configuration.

2. The mobility chair of claim 1, wherein the wheelchair is further comprised of a drive motor situated within the base frame, a battery in electrical communication with the drive motor, and a controller in operative communication with the battery, wherein the drive motor is operatively connected to the drive wheels, wherein the hoist is further comprised of a first actuator and a second actuator, wherein a lower segment of the first actuator is hingedly connected to the base frame and an upper segment of the first actuator is rotatably connected to the proximal segment of the telescopic boom, and wherein the second actuator is connected between the proximal segment and the distal segment of the telescopic boom.

3. The mobility chair of claim 2, wherein the mast is comprised of a bottom panel rotatably connected through a hinge to a back panel, wherein a front section of the seat bottom is comprised of a hinge bracket rotatably connected to the base frame, wherein the seat bottom is fixedly attached to the bottom panel, wherein the seatback is fixedly attached to the back panel, wherein with the seat bottom is in a substantially horizontal orientation and the seatback is in a substantially vertical orientation when the hoist is in the stowed configuration, wherein the seat bottom and the seatback are in an upright standing configuration with the seat bottom being substantially aligned with the seatback in a substantially vertical orientation when the hoist is in the operative configuration.

4. The mobility chair of claim 2, wherein the first actuator is further comprised of a first motor, wherein the second actuator is further comprised of a second motor, wherein the first motor operatively translates the upper segment relative to the lower segment and raises and lowers the proximal segment of the telescopic boom with the upper segment, wherein the proximal segment of the telescopic boom rotates relative to a top end of the mast, wherein the second actuator is a linear actuator fixedly connected between the proximal segment and the distal segment of the telescopic boom, and wherein the second motor operatively translates the distal segment forward and backward relative to the proximal segment.

5. The mobility chair of claim 4, further comprising a third actuator and a third motor, wherein the third actuator is rotatably connected between a lower portion of the upper segment of the first actuator and an intermediate portion of the proximal segment of the telescopic boom, wherein the upper segment of the first actuator is hingedly connected to an upper section of a back panel that is fixedly attached to the seatback, wherein the upper section of the back panel is further comprised of a hinge attached proximate to the top end of the mast, wherein a forward portion of the proximal segment of the telescopic boom is rotatably attached to the hinge at the top end of the mast, and wherein the third motor operatively rotates the proximal segment of the telescopic boom relative to the upper segment of the first actuator and relative to the mast.

6. The mobility chair of claim 4, further comprising a fourth actuator and a fourth motor, wherein the fourth actuator is rotatably connected between the lower portion of the upper segment of the first actuator and an intermediate section of the back panel below the upper section where the first actuator is hingedly connected, wherein the fourth motor operatively rotates the back panel relative to the upper segment of the first actuator, and wherein the battery powers at least one of the first motor, the second motor, the third motor, and the fourth motor.

7. The mobility chair of claim 2, wherein a topside of the seatback has an uppermost seat height when the seat bottom in a substantially horizontal orientation and the seatback is in a substantially vertical orientation, wherein a top end of the hoist in the stowed configuration is in a horizontal plane that is at or below a height that is no more than 120% of the uppermost seat height.

8. The mobility chair of claim 2, wherein the forwardmost end of the telescopic boom's distal segment is moved upward and forward ahead of the mast to the vertical lift axis when the forwardmost end is in the fully extended position, and wherein the vertical lift axis is ahead of a forwardmost section of the seat bottom and is behind the distal end of the outriggers in the extended configuration.

9. The mobility chair of claim 1, wherein the telescopic boom is behind the drive wheels when the hoist is in the stowed configuration, wherein a forward portion of the telescopic boom's proximal segment moves upward from the base frame and rotates forward to a position that is vertically above or ahead of the drive wheels when the forwardmost end of the distal segment is in the fully extended position, and wherein at least a portion of the telescopic boom's proximal segment is behind the mast and the drive wheels when the forwardmost end of the distal segment is in the fully extended position.

10. The mobility chair of claim 1, further comprising at least one turning wheel rotatably connected to the base frame opposite from the pair of safety wheels, wherein a thickness of hoist in the stowed configuration is less than the front wheelbase and a rear wheelbase between the drive wheels and the turning wheel.

11. A mobility chair, comprising:

a wheelchair comprising a base frame, a seat bottom rotatably connected to the base frame through a pivot bracket at a front section of the seat bottom, a seatback connected to a back section of the seat bottom through a hinge bracket at a lower section of the seatback, a pair of drive wheels connected to the base frame, a pair of safety wheels connected to a front portion of the base frame, a drive motor situated within the base frame, a battery in electrical communication with the drive motor, and a controller in operative communication with the battery, wherein the drive motor is operatively connected to the drive wheels, and wherein the seat bottom is in a substantially horizontal orientation and the seatback is in a substantially vertical orientation;

a hoist comprising a mast, a boom a boom actuator, a winch with a winch motor and a winch line, and a fling connected to the winch through the winch line wherein the hoist is connected to at least one of the base frame and the seatback, wherein the hoist moves between a stowed configuration and an operative configuration, wherein the winch is connected to the boom, wherein the winch motor extends and retracts the winch line relative to the winch, wherein the boom actuator moves a forwardmost end of the boom from a fully retracted position behind the seatback when the hoist is in the stowed configuration to a fully extended position with the winch line hanging along a vertical lift axis ahead of the front portion of the base frame when the hoist is in the operative configuration, wherein the forwardmost end of the boom extends ahead of a forwardmost section of the seat bottom in the fully extended position, and wherein at least a portion of the boom is behind the mast when the forwardmost end is in the fully extended position.

12. The mobility chair of claim 11, further comprising a seatback height actuator operatively connected to the seatback, wherein the seatback height actuator raises and lowers the seatback relative to the base frame between a first configuration and a second configuration, wherein the seat bottom is in the substantially horizontal orientation and the seatback is in the substantially vertical orientation in the first configuration, and wherein the seat bottom and the seatback are substantially aligned in a substantially vertical orientation in the second configuration.

13. The mobility chair of claim 11, further comprising a pair of outriggers connected to the base frame wherein the outriggers move between a retracted configuration and an extended configuration, wherein a distal end of each of the outrigger is proximate to the safety wheels and is below the front portion of the base frame in the retracted configuration, and wherein a length between the front portion of the base frame and the distal end of each of the outriggers in the extended configuration is greater than a wheelbase between the drive wheels and the safety wheels.

14. The mobility chair of claim 13, wherein the boom is telescopic and is further comprised of a proximal segment, a distal segment, a telescoping actuator connected between the proximal segment and the distal segment, and a motor, wherein the motor longitudinally translates the distal segment forward and backward relative to the proximal segment, wherein the winch is connected to and translates with the distal segment, and wherein the telescopic boom rotates relative to the mast as the hoist moves between the stowed configuration and the operative configuration.

15. The mobility chair of claim 14, wherein the telescopic boom is behind the drive wheels when the hoist is in the stowed configuration, wherein a forward portion of the telescopic boom's proximal segment moves upward from the base frame and rotates forward to a position that is vertically above or ahead of the drive wheels when the forwardmost end of the distal segment is in the fully extended position, wherein the forwardmost end of the telescopic boom's distal segment is moved forward ahead of the mast to the vertical lift axis when the forwardmost end is in the fully extended position, and wherein the vertical lift axis is behind the distal end of the outriggers in the extended configuration.

16. A mobility chair, comprising:

a wheelchair comprising a base frame, a seat bottom connected to the base frame, a seatback connected to at least one of the base frame and the seat bottom, a pair of drive wheels connected to the base frame, a pair of safety wheels connected to a front portion of the base frame, a drive motor situated within the base frame, a battery in electrical communication with the drive motor, and a controller in operative communication with the battery, wherein the drive motor is operatively connected to the drive wheels;

a pair of outriggers connected to the base frame, wherein the outriggers move between a retracted configuration and an extended configuration, wherein a distal end of each of the outriggers is proximate to the safety wheels and is below the front portion of the base frame in the retracted configuration, and wherein a length between the front portion of the base frame and the distal end in the extended configuration is greater than a wheelbase between the drive wheels and the safety wheels; and a hoist comprising a mast, a boom, a boom actuator, a winch with a winch motor and a winch line, and a sling connected to the winch through the winch line, wherein the hoist is connected to at least one of the base frame and the seatback, wherein the hoist moves between a stowed configuration and an operative configuration, wherein the winch is connected to the boom, wherein the winch motor extends and retracts the winch line relative to the winch, wherein the boom actuator moves a forwardmost end of the boom from a fully retracted position behind the seatback when the hoist is in the stowed configuration to a fully extended position with the winch line hanging along a vertical lift axis ahead of the front portion of the base frame when the hoist is in the operative configuration, wherein the forwardmost end of the boom extends ahead of a forwardmost section of the seat bottom in the fully extended position, and wherein at least a portion of the boom is behind the mast when the forwardmost end is in the fully extended position.

17. The mobility chair of claim 16, wherein the mast is comprised of a bottom panel rotatably connected through a hinge to a back panel, wherein a front section of the seat bottom is comprised of a hinge bracket rotatably connected to the base frame, wherein the seat bottom is fixedly attached to the bottom panel, wherein the seatback is fixedly attached to the back panel, wherein the seat bottom is in a substantially horizontal orientation and the seatback is in a substantially vertical orientation when the hoist is in the stowed configuration, wherein the seat bottom and the seatback are in an upright standing configuration with the seat bottom being substantially aligned with the seatback in a substantially vertical orientation when the hoist is in the operative configuration.

18. The mobility chair of claim 16, wherein the boom is telescopic and is further comprised of a proximal segment, a distal segment, a telescoping actuator connected between the proximal segment and the distal segment, and a motor, wherein the motor longitudinally translates the distal segment forward and backward relative to the proximal segment, wherein the winch is connected to and translates with the distal segment, and wherein the telescopic boom rotates relative to the mast as the hoist moves between the stowed configuration and the operative configuration.

19. The mobility chair of claim 18, wherein the telescopic boom is behind the drive wheels when the hoist is in the stowed configuration, wherein a forward portion of the telescopic boom's proximal segment moves upward from the base frame and rotates forward to a position that is vertically above or ahead of the drive wheels when the forwardmost end of the distal segment is in the fully extended position, wherein the forwardmost end of the telescopic boom's distal segment is moved forward ahead of the mast to the vertical lift axis when the forwardmost end is in the fully extended position, and wherein the vertical lift axis is behind the distal end of the outriggers in the extended configuration.

20. The mobility chair of claim 16, further comprising at least one turning wheel rotatably connected to the base frame opposite from the pair of safety wheels.

* * * * *